US005390582A

United States Patent [19]

Sanderson

[11] Patent Number: 5,390,582

[45] Date of Patent: Feb. 21, 1995

[54] PLANK-MOUNTED AIRCRAFT ARMANENT APPARATUS

[76] Inventor: Paul H. Sanderson, 2019 Cripple Creek, Lewisville, Tex. 75067

[21] Appl. No.: 60,867

[22] Filed: May 12, 1993

[51] Int. Cl.[6] ..... F41A 23/52

[52] U.S. Cl. ..... 89/37.22; 89/37.03

[58] Field of Search ..... 89/37.22, 37.19, 37.16, 89/37.03

[56] References Cited

U.S. PATENT DOCUMENTS 4,966,063 10/1990 Sanderson et al. ..... 89/37.22

5,187,318 2/1993 Sanderson et al. ..... 89/37.22

*Primary Examiner*—Stephen M. Johnson

*Attorney, Agent, or Firm*—Konneker Bush Hitt & Chwang

[57] ABSTRACT

An aircraft armament mounting system includes an elongated support plank member which is insertable transversely through the aircraft cabin area so that a central portion of the plank is disposed within the cabin area and its opposite end portions project outwardly from the aircraft. The central plank portion is anchored to the air craft, and removable outer tip portions of the plank are vertically pivotable, about horizontal hinge lines, between extended and inwardly folded positions. When the outer plank tip portions are removed, specially designed mounting structures may be used to mount armament devices, such as machine guns, at the hinge lines at the outer ends of the remaining longitudinal plank portion. Representatively, these armament devices are .50 caliber machine guns housed in open framed pod structures having enclosed front end portions through which the jacketed barrels of the guns extend. Secured to these front end portions, and communicating with their interiors, are slotted blast suppressor tubes that receive the gun barrels and serve to shield the sides of the aircraft from the firing blasts of the guns, and to reduce the firing blast light transmitted into the aircraft cabin area.

10 Claims, 3 Drawing Sheets

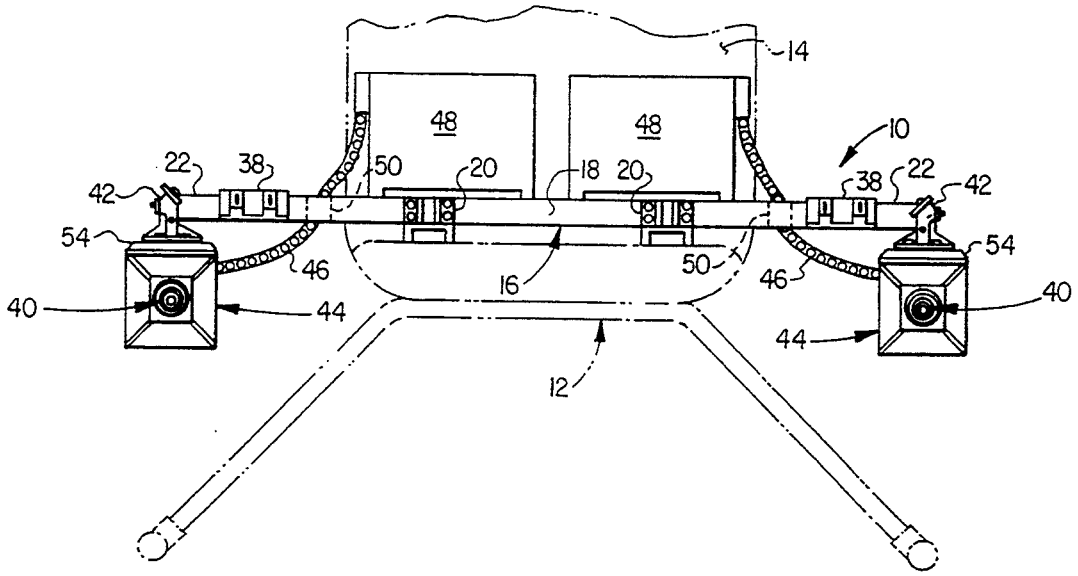
FIG. 1
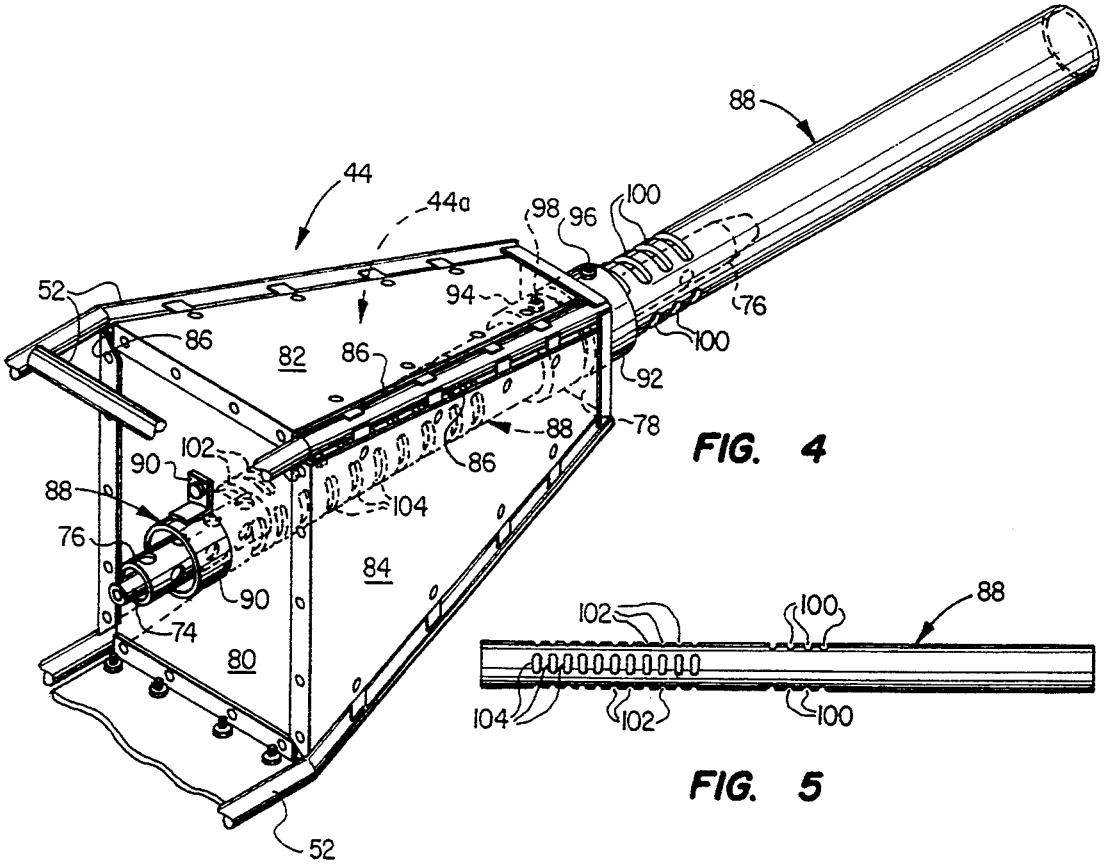
FIG. 4
FIG. 5

PLANK-MOUNTED AIRCRAFT ARMANENT APPARATUS

BACKGROUND OF THE INVENTION

The present invention relates generally to armament apparatus for aircraft, and more particularly relates to the external support plank mounting of weaponry, such as machine guns, at the cabin area of aircraft such as helicopters.

The external mounting on aircraft of weaponry such as machine guns, rocket launchers and the like, particularly in retrofit applications, has heretofore carried with it a variety of structural, operational and safety limitations and disadvantages. As but one example, the external mounting of machine guns on a helicopter has previously entailed securing an outwardly projecting metal support tube to the helicopter and then mounting the gun on the tube. While this seems to be a fairly straightforward approach, unavoidable limberness in the support tube often led to firing inaccuracies in the mounted gun due to wobbling of its firing axis relative to the aircraft.

To a great extent these problems have been eliminated by using the honeycombed metal support plank structure illustrated and described in U.S. Pat. No. 5,024,138 to Sanderson et al. This support plank structure is transversely insertable through the cabin portion of the aircraft in a manner such that a longitudinally central portion of the support plank is disposed within the cabin area, and outer end portions of the plank project outwardly from opposite sides of the body of the aircraft. The central plank portion within the cabin area is removably anchored to the aircraft (which may be a helicopter or a fixed wing aircraft) and outer tip portions of the plank are vertically pivotable, along plank structure hinge lines, between fully extended positions and upwardly and inwardly folded transport or storage positions.

At the outer ends of these foldable tip portions are downwardly projecting outboard weaponry mounting structures which are operative to removably support a pair of multiple tube rocket launchers at their bottom ends. Mounted on the undersides of the outwardly projecting plank end portions, inwardly of the foldable plank tips, are a pair of inboard support structures operative to removably support a pair of machine guns.

While the support plank-based aircraft armament system illustrated and described in U.S. Pat. No. 5,024,138 has proven to be structurally superior to metal tube-type weaponry support systems, use of the system has demonstrated a need in some instances to provide it with additional weaponry mounting and operation features and improvements.

For example, in some applications it would be desirable to temporarily remove the outer plank tip portions (and any armament which may be secured thereto) to reduce the overall armament weight, while at the same time mounting the machine guns further away from the opposite sides of the aircraft in order to reduce the laterally directed gun blast pressure forces exerted on the aircraft body. However, since the location of each inboard mounting structure is fixed, and the outboard mounting structures removed, this inboard weaponry repositioning is not feasible with the described plank structure and the associated mounting structures currently associated therewith.

When the inboard mounted weaponry comprises a pair of .50 caliber machine guns, the above-mentioned gun blast pressure forces against the sides of the aircraft are particularly acute. Additionally, in some applications the muzzle flashes from the guns tend to interfere with the aircraft crew's night vision equipment when the guns are mounted on the plank using existing gun pod support apparatus. It is accordingly an object of the present invention to provide improved support plank-based armament apparatus which eliminates or at least substantially reduces these limitations and problems.

SUMMARY OF THE INVENTION

In carrying out principles of the present invention, in accordance with a preferred embodiment thereof, armament apparatus is provided for an aircraft having a cabin area, representatively a helicopter. The armament apparatus includes an elongated support plank member having a longitudinally central portion positioned between outer end portions of the plank, each of the outer plank end portions including an outer tip portion.

Hinge means are provided for removably securing the outer plank tip portions to the balance of the plank for pivotal movement relative thereto between extended positions in which the tip portions define outer extensions of the balance of the plank, and retracted positions in which the tip portions are pivoted upwardly and inwardly onto the outer end portions of the plank. The hinge means include spaced pluralities of first hinge lugs formed on the tip portions and being removably interdigitatable with spaced pluralities of second hinge lugs formed on the outer plank end portions inwardly of the tip portions, and pin means for removably holding the pluralities of first hinge lugs in an interdigitated relationship with their associated pluralities of second hinge lugs.

Means are provided for securing the central portion of the plank member to the aircraft within its cabin area in a manner such that the outer plank end portions project outwardly beyond opposite sides of the aircraft. Additionally, means are provided for operatively mounting weaponry on the outer plank tip portions.

The armament apparatus also includes first and second gun pod structures each having a machine gun operatively supported therein and spaced pluralities of third hinge lugs secured to top sides thereof. The pluralities of third hinge lugs, when the outer plank tip portions (and any weaponry secured thereto) are removed from the plank, are interdigitatable with the pluralities of second hinge lugs and pivotally securable thereto using the aforementioned pin means to thereby removably secure the gun pods to the support plank, in a depending relationship therewith, in place of the removed outer tip portions of the support plank.

According to another feature of the invention, in a preferred embodiment thereof, each of the gun pods includes a frame structure within which one of the machine guns, each representatively a .50 caliber machine gun, is operatively supported, the machine gun having a jacketed barrel extending forwardly through a front portion of the frame structure, and a body portion disposed rearwardly of the front frame structure portion. Wall means are provided for substantially enclosing the front frame structure portion.

A slotted, open-ended blast suppressor tube coaxially and outwardly circumscribes the jacketed gun barrel and has a first end portion extending through the interior of the front frame structure portion, and a second end portion projecting forwardly beyond the front frame structure end portion and the jacketed gun barrel. Means are provided for supporting the blast suppressor tube on the wall means in a manner such that the jacketed gun barrel extends through but is not secured to or in contact with the blast suppressor tube.

The blast suppressor tube, in cooperation with the substantially enclosed front frame structure portion through which it extends, functions to substantially reduce firing flash which would otherwise interfere with the aircraft crew's night vision equipment, and also reduces the lateral firing gas forces exerted on the side of the aircraft. This reduction in such firing gas forces is enhanced by the ability to mount the machine guns at the plank hinge lines instead of inboard thereof on the plank.

While in the preferred embodiment of the present invention, each of the gun pods thereof is representatively mounted at one of the hinge lines of the support plank, it will be appreciated that each gun pod may of course be mounted at other locations on the plank, or be exteriorly mounted on the aircraft by mounting means other than the described support plank structure if desired.

BRIEF DESCRIPTION OF THE DRAWINGS

FIG. 1 is a partial front elevational view, in phantom, of a representative helicopter to which is operatively secured improved armament apparatus of the present invention that comprises an elongated armament support plank member carrying a pair of pod-mounted .50 caliber machine guns provided with specially designed blast suppressor apparatus;

FIG. 4 is an enlarged scale perspective view of a front end portion of the gun pod structure and its associated blast suppressor apparatus; and FIG. 5 is a reduced scale side elevational view of the blast suppressor tube removed from the gun pod structure.

DETAILED DESCRIPTION

Figure 2:
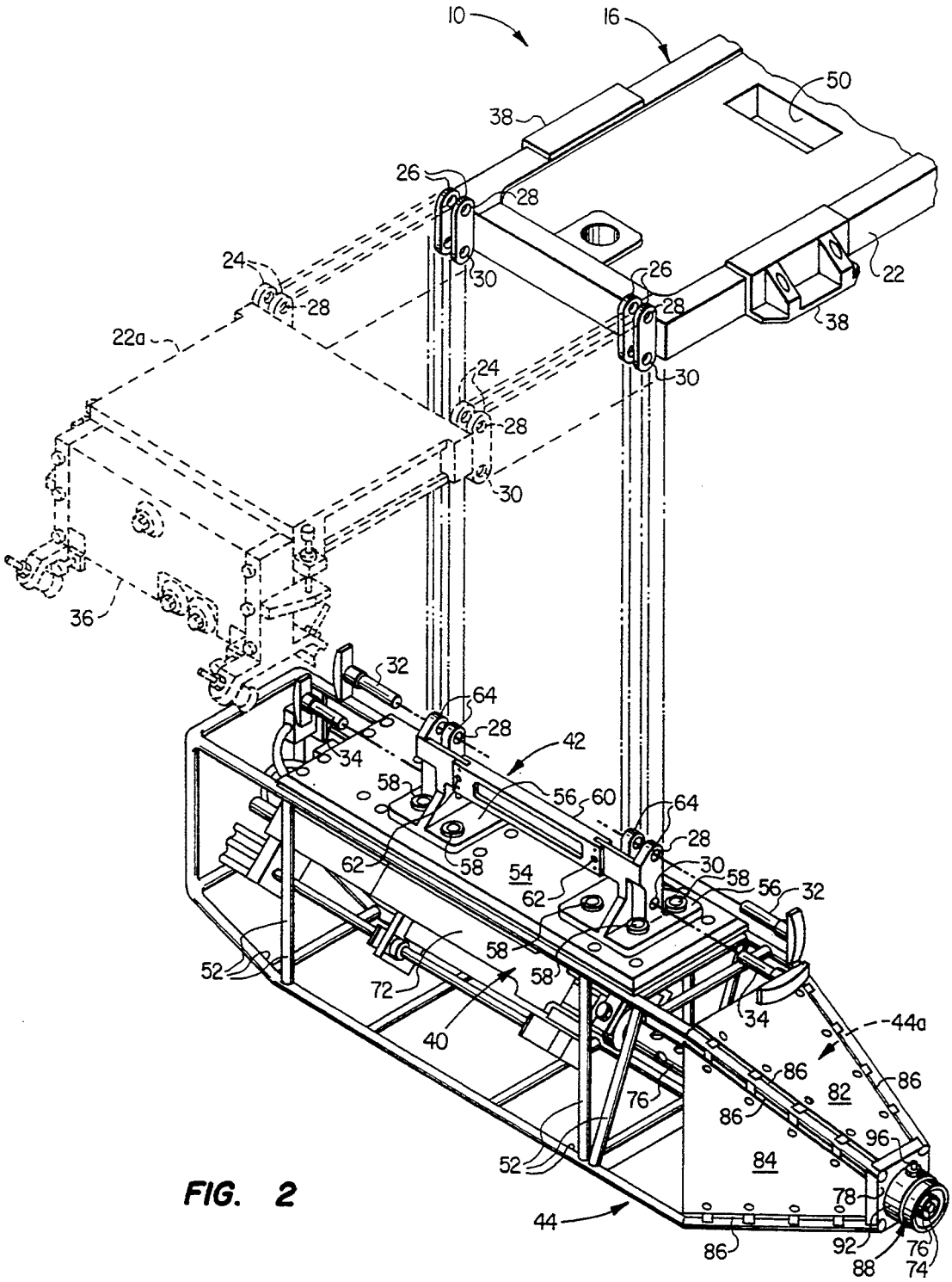
FIG. 2 is an enlarged scale, partially phantomed exploded perspective view of an outer end portion of the plank member and the machine gun and associated gun pod structure secured thereto, a substantial longitudinal portion of the machine gun blast suppressor tube having been removed for illustrative purposes.

Referring initially to FIGS. 1 and 2, the present invention provides improved armament apparatus 10 which is operatively connected to a representative helicopter 12 having a cabin area 14 (see FIG. 1) disposed behind its cockpit. The armament apparatus 10 includes an elongated support plank member 16 substantially identical to that illustrated and described in U.S. Pat. No. 5,024,138. Plank 16 is of a metal honeycomb construction, extends transversely through the cabin area 14, through suitable opposite side openings formed in the helicopter body, and has a central longitudinal portion 18 removably secured within a bottom portion of the cabin by suitable anchoring structures 20.

Outer end portions 22 of the plank 16 project outwardly beyond the opposite sides of the helicopter body and, as illustrated in phantom in FIG. 2, have outer tip portions 22*a*. In the use of the plank structure 16 as illustrated and described in U.S. Pat. No. 5,024,138 these tip portions 22*a* are pivotally joined to the balance of the plank structure by hinge lug pairs 24,26 respectively secured to the tips 22*a* and the balance of the outer end portions 22.

As indicated in FIG. 2, each of the lugs in the pairs 24,26 thereof have upper and lower circular holes 28,30 formed therein. When the tip portions 22*a* are operatively secured to the plank structure, the lug pairs 24 are interdigitated with their facing lug pairs 26 to respectively align the holes 28,30 in lugs 24 with the holes 28,30 in the lugs 26, and suitable upper and lower locking pin members 32,34 are respectively inserted through the aligned holes 28 and 30.

An outboard mounting structure 36 is secured to and depends from each of the plank tip portions 22*a* and is used to removably support weaponry, representatively a multiple tube rocket launcher (not shown), thereon. By removing the lower pin members 34 the tip portions 22*a*, and the weaponry secured thereto may be upwardly and inwardly pivoted to a storage or transport position about the hinge structure defined by the interdigitated sets of hinge lugs 24,26 and the remaining pins 32.

Positioned inboard of the lugs 26, on the leading and trailing edges of the outer plank end portions 22, are a pair of inboard mounting bracket structures 38 used to removably support weaponry, representatively a machine gun (not shown), thereon. As the support plank structure 16 is used in the present invention, the plank tip sections 22*a* (and the weaponry carried thereby) are removed from the balance of the plank structure 16 as indicated in FIG. 2, and the weapons (for example, a pair of machine guns) secured to the pairs of inboard mounting bracket structures 38 are also removed.

Figure 3:
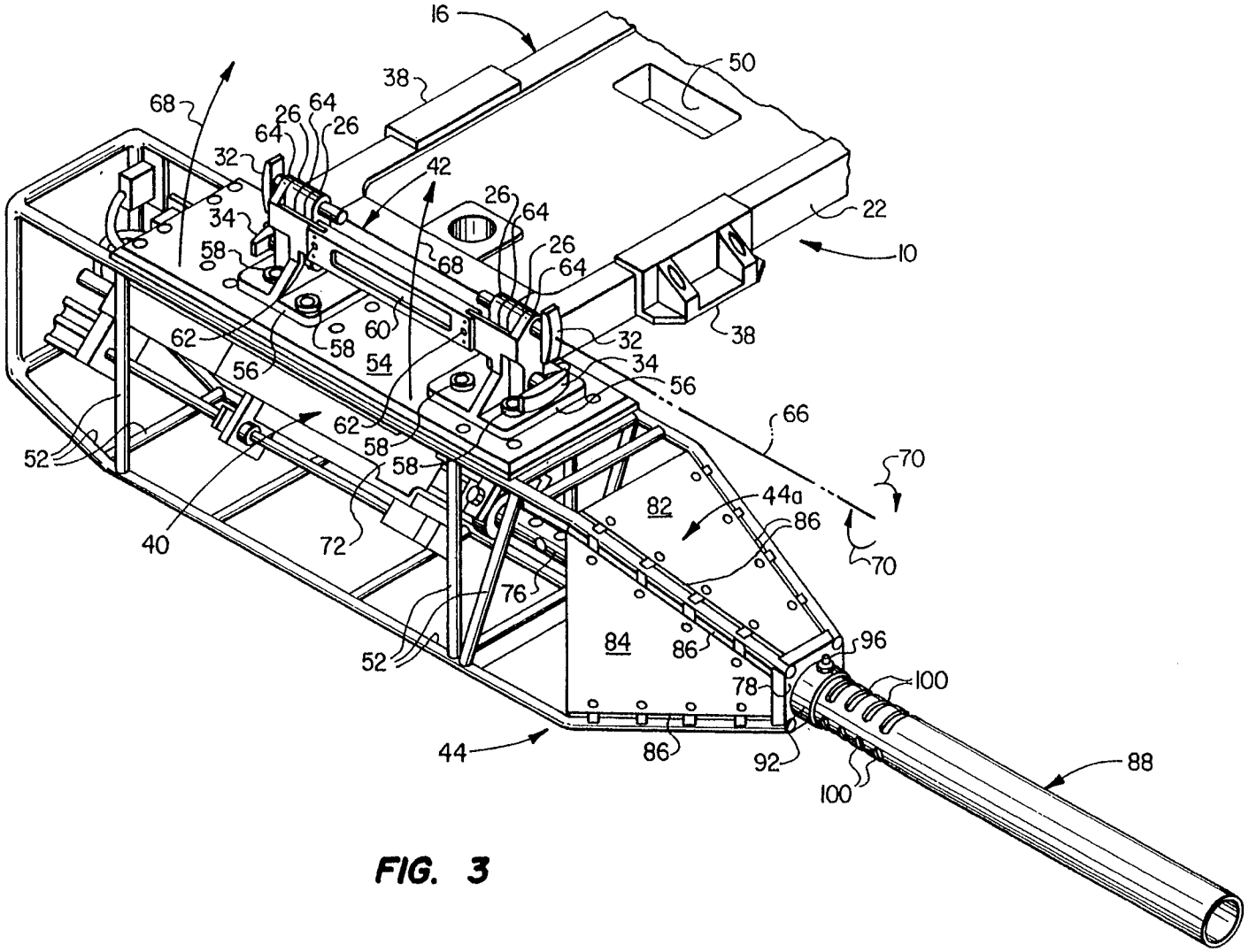
FIG. 3 is a view similar to that in FIG. 2, but with the machine gun and its associated pod structure being operatively secured to the plank member.

Referring now to FIGS. 1—3, with the tip sections 22*a* removed from the outer plank end portions 22, and the weaponry removed from the inboard bracket structures 38, a pair of .50 caliber machine guns 40 are secured to the hinge lugs 26 at the opposite outer ends of the now shortened plank structure 16 using specially designed mounting structures 42 secured to uniquely configured gun pod assemblies 44 embodying principles of the present invention. Belted ammunition 46 (see FIG. 1) is routed to the machine guns 40 from magazine boxes 48, secured to the top side of the plank structure within the cabin area 14, through rectangular openings 50 formed through the outer plank end portions 22 inboard of their outer tip hinge lines.

Each of the gun pods 44 has a generally open construction formed by a tubular metal frame structure 52, and has a rectangular cross-section along its length. An elongated metal support plate 54 is outwardly secured to the top side of the frame structure 52, with the machine gun 40 being secured to the underside of the plate 54. As best illustrated in FIG. 2, the pod mounting structure 42 includes a pair of brackets 56 removably secured to the top side of the plate 54 by suitable threaded fasteners 58. The brackets 56 are spaced apart from one another in a front-to-rear direction on the top side of the plate 54 and are removably anchored to the opposite ends of a metal spacing bar member 60 by suitable fastening members 62.

Fastening members 62 are threadingly received in tapped openings (not visible) formed in the top plate 54. The spacing bar 60 secured at its opposite ends to the brackets 56 serves to structurally reinforce the overall gun pod attachment apparatus. Additionally, it functions to accurately space the brackets 56 from one another so that their mounting openings may be quickly aligned with the associated openings in the top plate 54 when the brackets are to be attached to the plate. The spacing bar also prevents the brackets 56 from becoming separated from one another and misplaced prior to their attachment to the top plate 54.

As best illustrated in FIG. 2, a pair of hinge lugs 64 project upwardly from the top side of each of the bracket structures 56, each of the lugs 64 having top and bottom circular holes 28,30 formed therethrough. As shown in FIG. 3, to operatively mount the pod 44 on one of the outer plank end portions 22, the pairs of hinge lugs 64 are simply interdigitated with the hinge lug pairs 26 (in place of the dotted line hinge lugs 24 previously removed therefrom), and the top and bottom pins 32,34 are respectively inserted through the aligned lug openings 28,30 to thereby removably connect the machine gun pod 44 to the plank structure 16, at one of the hinge lines thereof, in place of the removed plank tip section 22*a*. By subsequently removing the lower pins 34, the pod 44 may pivoted upwardly and inwardly about the plank hinge line 66, to a storage/transport orientation, as indicated by the arrows 68 and 70 in FIG. 3.

Turning now to FIGS. 3–5, the .50 caliber machine gun 40 has a body portion 72 supported on the underside of plate 54 and depending therefrom within the interior of the pod 44. The barrel 74 is outwardly circumscribed by a tubular perforated barrel jacket 76 and extends forwardly through an enclosed front portion 44*a* of the otherwise generally open gun pod structure 44. The closed front portion 44*a* has, along its length, a generally rectangular cross-section and is forwardly and inwardly tapered.

The interior of the front portion 44*a* is enclosed by generally rectangular front and rear body panels 78 and 80, generally trapezoidal top and bottom panels 82, and generally trapezoidal opposite side panels 84. These body panels are suitably secured to the tubular framework of the pod, and small gaps 86 are present between the tubular framework and the side edges of the panels 82 and 84.

An open-ended metal blast suppressor tube 88 coaxially and outwardly circumscribes the barrel jacket 76 and extends through the interior of the closed front pod end portion 44*a*, extending outwardly beyond its front and rear end walls 78 and 80. A rear end portion of the tube 88 extends outwardly through a circular opening 90 in the rear panel 80 (see FIG. 4) and is secured to the panel 80 by an angle bracket 90 attached to the rear side of the panel 80. A longitudinally intermediate portion of the tube 88 extends through a circular opening in the front end panel 78 and is affixed to the front panel 78 by a pair of circular mounting collars 92 and 94 that outwardly circumscribe the tube 78.

Collar 92 is disposed against the outer side surface of the panel 78 and is locked to the tube 88 by a set screw 96, and collar 94 is disposed against the inner side surface of the panel 78 (within the interior of the front pod end portion 44*a*) and is locked to the tube 78 by a set screw 98. It should be noted that the gun barrel 74 and the ventilated jacket 76 that surrounds it merely extend forwardly into the tube 88, to a longitudinally intermediate portion thereof, but are not physically connected to the tube 88. Instead, the tube 88 is anchored at longitudinally spaced locations thereon solely to the enclosed front pod end portion 44*a*.

Longitudinally spaced series of circumferential blast relief slots 100 are formed in top and bottom side portions of the tube immediately forwardly of the collar 92, and similar top and bottom side slots 102 are formed in the portion of the tube 88 within the front pod end portion 44*a* . Additional series of slots 104 are formed on opposite side portions of the tube 88 between the series of slots 102.

As the machine gun 40 is fired during forward flight of the helicopter 12 the rapid inrush of air rearwardly through the blast suppressor tube 88 forces the firing flames and gases exiting the gun barrel rearwardly through the tube 88, with portions of such flames and gases exiting the tube slots 100, and additional portions of the flames and gases being discharged from the tube 88 into the interior of the front pod end portion 44*a* and then outwardly through its side edge gaps 86.

During firing of the gun 44, the interior of the front pod end portion 44*a* serves, in effect, as a temporary pressure accumulator into which firing flames and gases may be discharged through the slots 102,104 in the blast suppressor tube 88. It also serves to substantially shield the firing flames from view, thereby materially lessening firing flame interference with the night vision equipment used by the crew of the helicopter. Moreover, the enclosed front pod end portion 44*a*, together with the tube 88, serves to shield the adjacent side of the helicopter from the laterally directed firing gas pressure forces generated by the gun 40. The unique support of the blast suppressor tube 88 on the pod front end portion 44*a*, and not on the machine gun barrel or its perforated outer jacket, serves to prevent undesirable flexural fatigue forces from being imposed on the gun barrel by the tube 88.

It can be seen from the foregoing that the present invention alleviates the former potential gun firing problems muzzle flash and lateral pressure forces exerted on the helicopter, as well as providing other aircraft armament improvements, in two primary manners. First, the specially designed mounting structure on the gun pod 44 permits the machine gun 40 to be mounted further outboard on the plank 16, in place of the removed plank tip section 22*a*. Second, the combination of the enclosed front pod end portion 44*a* with the uniquely supported blast suppressor tube 88, serves to further lessen the muzzle flash and lateral pressure force problems associated with firing of the machine gun 40 during forward flight of the helicopter 12.

While in the illustrated preferred embodiment of the present invention, the specially designed machine gun pod structure has been shown mounted at the hinge line of the support plank, in place of a removed outer tip portion of the plank, it will be readily appreciated by those skilled in this art that the machine gun pod structure may alternatively mounted on another portion of the plank, or exteriorly secured to the helicopter or other aircraft by means other than the illustrated support plank member if desired.

The foregoing detailed description is to be clearly understood as being given by way of illustration and example only, the spirit and scope of the present invention being limited solely by the appended claims.

What is claimed is:

1. Armament apparatus for an aircraft having a cabin area, comprising:

an elongated support plank member having a longitudinally central portion positioned between outer end portions of the plank member, each of said outer end portions including an outer tip portion;

hinge means for removable securing said outer tip portions to the balance of said plank member for pivotal movement relative thereto between extended positions in which the tip portions define outer extensions of the balance of said plank member, and retracted positions in which said tip portions are pivoted upwardly and inwardly onto said outer end portions of said plank member, said hinge means including spaced pluralities of first hinge lugs formed on said tip portions, said spaced pluralities of first hinge lugs being removably interdigitatable with spaced pluralities of second hinge lugs formed on said outer plank member end portions inwardly of said tip portions and pin means for removably holding said pluralities of first hinge lugs in an interdigitated relationship with their associated pluralities of said second hinge lugs;

means for securing said central portion of the plank member to the aircraft within said cabin are thereof in a manner such that said outer end portions of the plank member project outwardly beyond opposite sides of the aircraft; and means for operatively mounting weaponry on said outer tip portions of the plank member;

first and second gun pod structures each having a machine gun operatively supported therein and spaced pluralities of third hinge lugs secured to top sides thereof, said pluralities of third hinge lugs when said outer tip portions are removed from said plank member, being interdigitatable with said pluralities of second hinge lugs and pivotally securable thereto using said pin means to thereby removable secure said gun pods to said support plank member, in a depending relationship therewith, in place of the removed outer tip portions of said support plank member, said first and second gun pod structures having top plate members from which said machine guns depend, said top plate members having spaced pluralities of mounting bracket members removably secured to their upper sides, and said pluralities of third hinge lugs being formed integrally with and projecting upwardly from said bracket members.

2. The armament apparatus of claim 1 wherein:

two of said mounting bracket members are removably secured to the upper side of each of said top plate members and are connected to the opposite ends of an elongated spacing bar.

3. The armament apparatus of claim 1 wherein:

said machine guns are .50 caliber machine guns.

4. Armament apparatus for an aircraft having a cabin area, comprising:

an elongated support plank member having a longitudinally central portion positioned between outer end portions of the plank member, each of said outer end portions including an outer tip portion;

hinge mean for removably securing said outer tip portions to the balance of said plank member for pivotal movement relative thereto between extended positions in which the tip portions define outer extensions of the balance of said plank member, and retracted positions in which said tip portions are piloted upwardly and inwardly onto said outer end portions of said plank member, said hinge means including spaced pluralities of first hinge lugs formed on said tip portions, said spaced pluralities of first hinge lugs being removably interdigitatable with spaced pluralities of second hinge lugs formed on said outer plank member end portions inwardly of said tip portions, and pin means for removably holding said pluralities of first hinge lugs in an interdigitated relationship with their associated pluralities of said second hinge lugs;

means for securing said central portion of the plank member to the aircraft within said cabin area thereof in a manner such that said outer end portions of the plank member project outwardly beyond opposite sides of the aircraft; and means for operatively mounting weaponry on said outer tip portions of the plank member;

first and second gun pod structures each having a machine gun operatively supported therein and spaced pluralities of third hinge lugs secured to top sides thereof, said pluralities of third hinge lugs, when said outer tip portions are removed from said plank member, being interdigitatable with said pluralities of second hinge lugs and pivotally securable thereto using said pin means to thereby removably secure said gun pods to said support plank member, in a depending relationship therewith, in place of the removed outer tip portions of said support plank member, each of said first and second gun pod structures including:

a frame structure within which one of said machine guns is operatively supported, the machine gun having a jacketed barrel extending forwardly through a front portion of said frame structure, and a body portion disposed rearwardly of said front frame structure portion, wall means for substantially enclosing said front frame structure portion;

a slotted, open-ended blast suppressor tube coaxially and outwardly circumscribing the jacketed gun barrel, said blast suppressor tube having a first end portion extending through the interior of said front frame structure portion, and a second end portion projecting forwardly beyond said front frame structure end portion and the jacketed gun barrel; and support means for supporting said blast suppressor tube on said wall means in a manner such that the jacketed gun barrel extends through but is not secured to or in contact with said blast suppressor tube.

5. The armament apparatus of claim 4 wherein:

said blast suppressor tube has a first longitudinally spaced series of slots disposed on said first end portion thereof.

6. The armament apparatus of claim 5 wherein:

said blast suppressor tube has a second longitudinally spaced series of slots disposed on said second end portion thereof.

7. The armament apparatus of claim 5 wherein:

said wall means include front, rear, top and bottom and opposite side wall panels secured to said frame structure, and said top and bottom and opposite side wall panels have side edge portions spaced apart from adjacent portions of said frame structure and defining therewith gaps through which the interior of said front frame structure portion outwardly opens.

8. The armament apparatus of claim 4 wherein:

said wall means include spaced apart front and rear wall panels secured to said frame structure, and said support means include:

a circular opening extending through said rear wall panel and receiving a longitudinal portion of said blast suppressor tube, first means for securing said blast suppressor tube to said rear wall panel, a circular opening extending through said front wall panel and receiving a longitudinal portion of said blast suppressor tube, and second means for securing said blast suppressor tube to said front wall panel.

9. The armament apparatus of claim 8 wherein said first means include:

a bracket member intersecured between said blast suppressor tube and the outer side of said rear wall panel.

10. The armament apparatus of claim 8 wherein said second means include:

a first collar member circumscribing and locked to said blast suppressor tube, said first collar member being disposed within the interior of said front frame structure portion closely adjacent the inner side of said front wall panel, and a second collar member circumscribing and locked to said blast suppressor tube, said second collar member being disposed exteriorly of said front frame structure portion closely adjacent the outer side of said front wall panel.

* * * * *